US006363559B1

(12) United States Patent
Saxon

(10) Patent No.: US 6,363,559 B1
(45) Date of Patent: Apr. 2, 2002

(54) MASSAGE MOTOR MOUNTING ASSEMBLY

(75) Inventor: Donald C. Saxon, Bay Springs, MS (US)

(73) Assignee: Warmkraft, Inc., Taylorsville, MS (US)

( * ) Notice: Subject to any disclaimer, the term of this patent is extended or adjusted under 35 U.S.C. 154(b) by 0 days.

(21) Appl. No.: 09/641,744

(22) Filed: Aug. 18, 2000

Related U.S. Application Data

(60) Provisional application No. 60/149,650, filed on Aug. 18, 1999.

(51) Int. Cl.[7] ..... A47C 21/00

(52) U.S. Cl. ..... 5/694; 5/915; 601/59

(58) Field of Search ..... 5/108, 109, 258, 5/694, 915; 601/56, 57, 58, 59

(56) References Cited

U.S. PATENT DOCUMENTS

| | | | | | |
|---|---|---|---|---|---|
| 1,230,260 | A | * | 6/1917 | Young | 5/258 |
| 1,784,082 | A | | 12/1930 | Webb | |
| 2,715,901 | A | | 8/1955 | Blake | |
| 2,808,827 | A | | 10/1957 | O'Hara | |
| 2,910,977 | A | * | 11/1959 | Jeter | 5/109 |
| 2,951,478 | A | | 9/1960 | Tompkins | |
| 2,980,108 | A | | 4/1961 | Scott | |
| 3,035,572 | A | | 5/1962 | Houghtaling | |
| 3,048,168 | A | | 8/1962 | Kamp | |
| 3,194,522 | A | | 7/1965 | Azneer | 248/671 |
| 3,235,891 | A | | 2/1966 | Chade et al. | |
| 3,279,461 | A | | 10/1966 | Oliver | |
| 3,311,935 | A | | 4/1967 | Petty | |
| RE26,346 | E | | 2/1968 | Kamp | |
| 3,732,860 | A | | 5/1973 | Thurmer | |
| 4,544,867 | A | | 10/1985 | Jones, Jr. et al. | |
| 4,565,188 | A | | 1/1986 | Hardie | |
| 4,748,972 | A | | 6/1988 | Hasegawa | |
| 5,007,410 | A | | 4/1991 | DeLaney | |
| 5,014,687 | A | | 5/1991 | Raffel | |
| 5,076,260 | A | | 12/1991 | Komatsu | |
| 5,437,607 | A | | 8/1995 | Taylor | |
| 5,713,832 | A | | 2/1998 | Jain | |
| 5,940,914 | A | * | 8/1999 | Robbins | 5/694 |

* cited by examiner

*Primary Examiner*—Michael F. Trettel
(74) *Attorney, Agent, or Firm*—Volpe and Koenig, P.C.

(57) ABSTRACT

A mount for locating a motor assembly within a coil spring assembly. The spring assembly has at least one coil with a helical portion which defines an inner circumference between first and second ends of the helix and a generally planar, circular portion that is attached at an end of the helix. The mount comprises an upper plate dimensioned to overlie the circular portion. The upper plate has a central aperture which opens into a dependent tubular housing. The tubular housing has an exterior circumference less than the inner circumference defined by the helical portion of the spring and an inner circumference dimensioned to receive the motor assembly therein.

10 Claims, 1 Drawing Sheet

MASSAGE MOTOR MOUNTING ASSEMBLY

This application claims the benefit of U.S. Provisional Application No. 60/149,650 filed Aug. 18, 1999, now expired.

BACKGROUND

The present invention relates generally to a housing for mounting a vibratory motor within a coil spring. The present invention relates more specifically to mounting a vibratory motor within the coil springs of a mattress or pad intended to support one or more individuals. The present invention relates most specifically to a housing for mounting a vibratory motor within a coil spring of a mattress or a pad without modification of any individual spring or the spring arrangement within the mattress or pad.

Efforts to provide a massage or vibratory component to a mattress or support pad are well known in the art. For instance, see U.S. Pat. No. 26,346 (Kamp); U.S. Pat. No. 1,784,082 (Webb); U.S. Pat. No. 2,715,901 (Blake); U.S. Pat. No. 2,808,827 (O'Hara); U.S. Pat. No. 2,951,478 (Tompkins); U.S. Pat. No. 2,980,108 ( Scott); U.S. Pat. No. 3,035,572 (Houghtaling); U.S. Pat. No. 3,048,168 (Kamp); U.S. Pat. No. 3,194,522 (Azneer); 3,235,891 (Chade et al.); U.S. Pat. No. 3,279,461 (Oliver); U.S. Pat. No. 3,311,935 (Petty); U.S. Pat. No. 3,732,860 (Thurmers); U.S. Pat. No. 4,544,867 (Jones); U.S. Pat. No. 4,565,188 (Hardie); U.S. Pat. No. 4,748,972 (Hasegawa); U.S. Pat. No. 5,007,410 (DeLaney); U.S. Pat. No. 5,076,260 (Komatsu); U.S. Pat. No. 5,437,607 (Taylor).

The present invention provides a simple housing which is inserted within a coil spring to surround the vibratory motor and suspend it within the spring. The housing also provides a means for its attachment to a spring within the assembly.

SUMMARY

The present invention relates to a mount for locating a motor assembly within a coil spring assembly. A coil spring within the assembly has a helical portion which defines an inner circumference between first and second ends of the helix and a generally planar, circular portion, having a larger circumference than the inner circumference, that is attached at an end of the helix. The mount comprises an upper plate dimensioned to overlie the circular portion. The upper plate has a central aperture which opens into a dependent tubular housing. The tubular housing has an exterior circumference less than the inner circumference defined by the helical portion of the spring and an inner circumference dimensioned to hold the motor assembly therein.

DETAILED DESCRIPTION OF THE PREFERRED EMBODIMENTS

Figure 1:
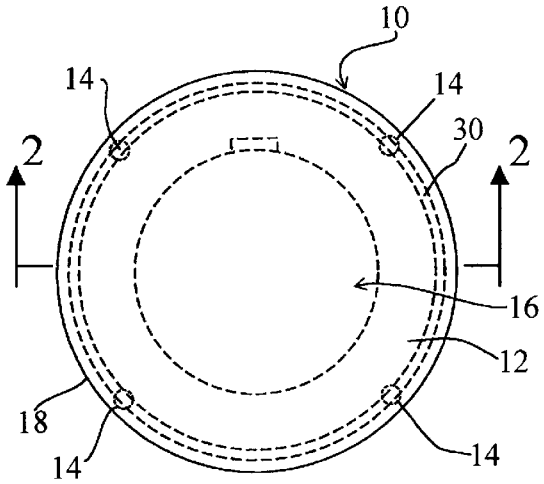
FIG. 1 is a top plan view of a vibratory motor mount in accordance with the invention with a vibratory motor assembly therein.
Figure 2:
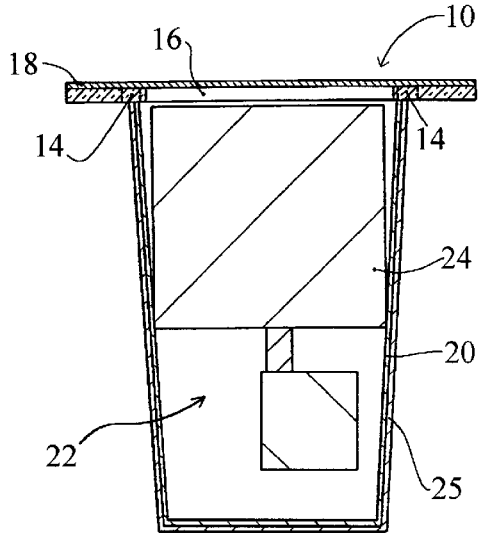
FIG. 2 is a section view along line 2—2 in FIG. 1.

With reference to FIGS. 1 and 2, the mount 10, which is preferably injection molded, is comprised of an upper plate

12 which includes a plurality of mounting holes 14 and a central bore or motor cavity 16. The central bore or motor cavity 16 is closed by the top cap plate 18. Depending from the underside of the plate 12 is a molded housing 20 which defines a motor cavity or bore 22. The cavity 22 is preferably coaxial with the aperture 16 and is dimensioned to receive a motor assembly 24 which passes through the aperture 16. As can be seen in FIG. 2, the tubular housing 20 preferably has a taper which accepts the motor assembly 24 in a suspended position and allows the shaft of the motor assembly 24 to rotate the eccentric weight 26 without contacting the interior of housing 20 that defines the bore 22. Instead of a taper, the housing 20 may be formed with stepped surfaces or the like to support the motor assembly 24.

Figure 3:
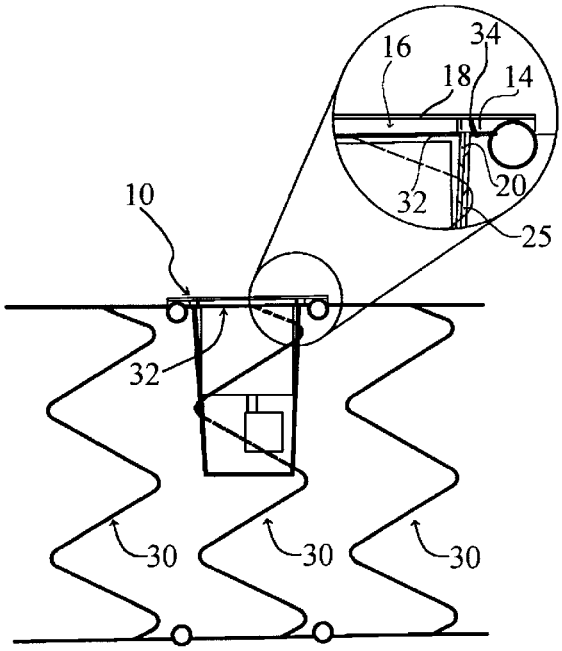
FIG. 3 is a side elevation illustrating the mounting of the assembly of FIG. 1 in a coil spring.

Referring to FIG. 3, it can be seen that the housing 20 is sized to fit within the helical or spiral coil portion of the spring 30. As will be known to the skilled in the art, a mattress or seating pad will have a plurality of springs 30 which are interconnected, see FIG. 4, to create a spring assembly. The outer dimension or circumference of the housing 20 is less than the inner dimension or circumference defined by the coil portion of spring 30 so that the housing 20 will fit within the coil spring 30 at its smallest dimension in the relaxed state.

Figure 4:
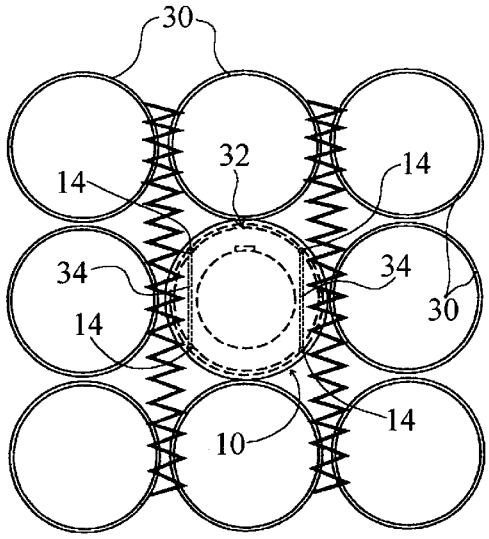
FIG. 4 is a top plan view of the vibratory motor and housing assembly mounted in a coil spring assembly.

With reference to FIG. 4, it can be seen that the assembly of housing 10 to the generally circular top coil 32 of the spring 30 is easily achieved by inserting the housing 10 into the spring 30 until it rests on the circular coil 32. The mounting holes 14 are positioned in alignment with the coil 32 such that connecting wire ties 34 or some other means of attachment can be secured through the mounting holes 14 to the circular coil 32. The wire ties 34 secure the mount 10 to the coil 32 such that vibration of the housing 20 will translate into and through the spring 30. After the motor assembly 24 is inserted through the aperture 16 and the upper plate 12 secured to the coil 32, the cap plate 18 is placed over and secured to the upper plate 12. The cap plate 18 preferably covers the mounting holes 14 such to prevent inadvertent losing of the wire ties 34 or the like.

The upper plate 12 and the depending housing 20 are preferably manufactured from a rigid plastic material or the like. As shown in FIG. 2, a soft layer 25 is preferably molded about the housing 20. The soft layer 25 may by manufactured from a soft plastic, rubber, or the like. The soft layer 25 acts to insulate the housing 20, thereby reducing the noise created by the vibration of the mount 10.

Through the use of the present invention, a vibratory motor may be added to a coil spring assembly without any particular modification of the spring assembly for acceptance of the vibratory motor. In addition, the simple mounting arrangement of the present housing provides for the easy relocation or addition of one or more vibratory motors.

It will appreciated by those skilled in the art that the mount and motor are selected in accordance with the end purpose of the spring assembly. It will also be appreciated by those skilled in the art that the molded housing 20 eliminates the need for additional hardware to mount the motor assembly 24 within the coil spring 30. Accordingly, changing or replacing the motor assembly 24 is greatly simplified.

What is claimed is:

1. A mount for locating a motor assembly within a coil spring having a helical portion which defines an inner circumference between first and second ends of the helix and a generally planar, circular portion, having a larger circumference than the inner circumference, that is attached at an end of the helix, the mount comprising:

an upper plate dimensioned to overlie the circular portion and having a central aperture which opens into a dependent tubular housing, the tubular housing having an exterior circumference less than the inner circumference defined by the helical portion of the spring and an inner circumference dimensioned to receive the motor assembly therein.

2. The mount of claim 1 wherein the housing has tapered walls which are configured to support the motor assembly.

3. The mount of claim 1 wherein the upper plate and the housing are manufactured from a rigid material.

4. The mount of claim 1 wherein at least a portion of the housing is encased in a soft layer.

5. The mount of claim 4 wherein the soft layer is formed of plastic.

6. The mount of claim 4 wherein the soft layer is formed of rubber.

7. The mount of claim 1 wherein the upper plate has at least one securing aperture extending therethrough and positioned in general alignment with the circular portion.

8. The mount of claim 7 wherein a securing member is extended through the securing aperture to secure the mount to the coil spring.

9. The mount of claim 7 further comprising a cap plate which is removably securable to the upper plate and configured to cover the central aperture and the securing aperture.

10. The mount of claim 1 further comprising a cap plate which is removably securable to the upper plate.

* * * * *